US008069759B2

(12) United States Patent
Ramseier

(10) Patent No.: US 8,069,759 B2
(45) Date of Patent: Dec. 6, 2011

(54) METHOD AND DEVICE FOR SEPARATING CONTINUOUSLY CONVEYED MATERIAL WEBS

(75) Inventor: Marcel Ramseier, Wetzikon (CH)

(73) Assignee: Ferag AG, Hinwil (CH)

( * ) Notice: Subject to any disclaimer, the term of this patent is extended or adjusted under 35 U.S.C. 154(b) by 559 days.

(21) Appl. No.: 12/170,757

(22) Filed: Jul. 10, 2008

(65) Prior Publication Data

US 2009/0013841 A1 Jan. 15, 2009

(30) Foreign Application Priority Data

Jul. 11, 2007 (CH) ..... 1116/07

(51) Int. Cl.
*B26D 1/00* (2006.01)
*B26D 1/56* (2006.01)
*B26D 7/06* (2006.01)

(52) U.S. Cl. ..... 83/13; 83/331; 83/123

(58) Field of Classification Search ..... 83/331, 83/123, 13, 678, 676, 698.41, 614, 607, 485; 144/136.1, 218, 240, 89, 91.2; 451/548
See application file for complete search history.

(56) References Cited

U.S. PATENT DOCUMENTS 1,473,377 A * 11/1923 Langston ..... 83/103
3,142,216 A * 7/1964 Rupnow ..... 83/308
4,589,458 A * 5/1986 McCord, Jr. ..... 144/238
4,625,925 A 12/1986 Goldhammer
4,643,060 A * 2/1987 Fremion ..... 83/171
4,717,328 A * 1/1988 D'Alterio ..... 425/290
5,309,962 A * 5/1994 McCord et al. ..... 144/237
5,890,409 A 4/1999 Carlton et al.
6,073,527 A * 6/2000 Harter et al. ..... 83/88
7,044,410 B2 * 5/2006 Hunag ..... 241/295

FOREIGN PATENT DOCUMENTS

| | | | |
|---|---|---|---|
| CH | 666651 | A5 | 8/1988 |
| DE | 3313103 | A1 | 10/1984 |
| DE | 3536989 | A1 | 4/1987 |
| DE | 202004004275 | U1 | 6/2004 |
| FR | 2394326 | | 1/1979 |
| WO | 98/33630 | | 8/1998 |
| WO | 2005/102624 | A1 | 11/2005 |

* cited by examiner

*Primary Examiner* — Ghassem Alie
(74) *Attorney, Agent, or Firm* — Rankin, Hill & Clark LLP

(57) ABSTRACT

Material webs (1), in particular printed products which are designed as two-ups or multiple-ups, are separated parallel to a conveyor direction (F) during an essentially continuous conveying, in that a waste strip is separated out of the material webs (1) in an alternating sequence of cutting steps. The material webs (1) in consecutive cutting steps, are cut in a shearing manner, and in an alternating manner on the one or the other side of the waste strip between essentially straight-lined cutting edges (3, 5) of the cutting knife (4) and the counter-knife (5). The cutting knives (4) are arranged around the periphery of a separating disk (2) rotating running in the same direction as the conveyor direction (F), wherein its cutting edges (3, 3') lie in an alternating manner in the plane of the one and the other end-side of the separating disk (2). In each case, a stationary counter-knife (6) is aligned onto in each case one of the two end-sides of the separating disk (2).

16 Claims, 5 Drawing Sheets

METHOD AND DEVICE FOR SEPARATING CONTINUOUSLY CONVEYED MATERIAL WEBS

BACKGROUND OF THE INVENTION

The invention lies in the field of paper processing, and relates to a method and a device for separating continuously conveyed material webs, wherein the separation is effected roughly parallel to the conveyor direction. The method and the device are particularly suitable for separating multi-sided printed products which are designed as two-ups or multiple-ups, and which comprise two or more than two equal or different exemplars, and which are conveyed in a flow in a manner such that exemplars connected to one another in a printed product are arranged next to one another, and, for all printed products, are aligned to one another in the conveyor direction. Of course, other applications of the method and device according to the invention are also conceivable.

In contrast to the process of cutting printed products, in which edge regions are cut away from the printed products in a head cut, foot cut and/or front cut, and for this reason the quality of the paper edges is only important on the side of the printed product, but not on the side of the cut-away section, on separating multiple-ups, it is important that both edges arising due to the separation have an as high quality as possible.

It has been found that an edge quality which is equally good on both sides when separating continuously conveyed material webs may be better achieved if the separation is not effected by a single cut, but by way of creating a separating gap either by way of sawing or milling, and the removal of swarf-like waste, or by way of parallel cutting along two parallel cutting lines which run as closely as possible to one another, wherein a narrow waste strip arises between the two separated parts.

The publication CH-666651 describes a device for separating continuously conveyed material webs, in particular from an imbricate flow of printed products, with the help of a separating disk which is rotatably driven and which comprises two circular cutting edges arranged in each case in the plane of an end-face of the disk. Each of the two cutting edges thereby is arranged cooperating with a counter-knife rotating in the opposite direction, wherein the counter-knives too have a circular cutting edge in each case. The material webs are pressed against one another for the separation. The separating disk for example has a hollow grinding around its periphery, or consists of two disk parts applied against one another, wherein the sides of the two disk parts which face one another are obliquely ground on their periphery. Evidently, the material webs in such a device are separated by two cutting processes running in parallel, in a manner such that a waste strip arises between the two separated product parts.

It is also suggested, in the same publication, to design the separating disk as a milling disk or saw disk with a saw-tooth grinding, thus not as a cutting tool but as a material-removing tool. In the case of the saw-tooth grinding, it is suggested instead of the setting of the teeth common for sawing, to arrange these on two symmetrical disk parts which correspond to the disk parts mentioned further above.

A rotating separating disk for separating continuously conveyed material webs is likewise disclosed in the publication WO-2005/102624. This, on its periphery, comprises alternating saw teeth and peeling knives, wherein the cutting edges of the peeling knives lie in an alternating manner in the plane of the one, and in the plane of the other end-face of the separating disk. The function of the saw teeth lies in clearing a separating gap in a material-removing manner. The function of the peeling knife lies in improving the paper edges arising from the clearing, on both sides of the sawn gap, in a peeling cut. Thereby, the separating disk is operated in the opposite direction with regard to the conveying, in a manner such that the peeling knives cut essentially in the direction of the material webs and counter to the conveyor direction, by which means the application of a counter-knife is rendered superfluous for the peeling procedure (as well as, of course, for the sawing procedure).

It has been found that there is scope for improvement with regard to the edge quality, on separating continuously conveyed material webs. It is, therefore, the object of the invention to provide a further method and a further device, which are suitable for the separation of essentially continuously conveyed material webs, wherein the paper edges arising on separation should fulfill high demands with regard to the quality. Moreover, the method according to the invention should permit a device which is very space-saving.

BRIEF SUMMARY OF THE INVENTION

According to the invention, a pure cutting process is applied for the separation of continuously conveyed material webs, thus not material-removing steps. The mentioned cutting process is shearing cutting, which means a cutting between two crossing cutting edges of a cutting knife and a counter-knife cooperating with the cutting knife, wherein the two cutting edges are essentially straight-lined, and the cutting edge of the cutting knife is advantageously arranged on a rotating separating disk, and the material webs bear on the cutting edge of the counter-knife. The cutting process is carried out in directly consecutive cutting steps in an alternating manner on the one, and on the other side of a separating gap, in a manner such that a narrow waste strip is cut out from the material webs. Alternatively, the cutting steps are carried out synchronously on both sides of the separating gap. The material webs are pressed on one another on both sides of the arising separating gap, so that they snugly bear on the cutting edge of the counter-knife where the cutting edges act. The counter-knives are preferably stationary during the separation, and are particularly preferably displaceable parallel to the conveyor direction for extending their serviceable life.

Preferably, in each case, a plurality of cutting knives are arranged on the separating disk for the alternating or synchronous cutting steps.

The material webs to be separated are, for example, quasi endless paper webs, or are stacks of material webs which are conveyed one after the other, for example multi-sided printed products, in particular, as mentioned above, two-ups or multiple-ups. If such printed products are relatively thin (for example only two-sided or four-sided), the method according to the invention provides for a separation with paper edges which meet the highest demands with regard to quality, also for printed products which partially overlap one another, thus for an imbricate flow of the printed products.

Thus, a plurality of cutting knives which are arranged around the periphery of a separating disk in an alternating manner, and two counter-knives with straight-lined cutting edges aligned parallel to the conveyor direction, are applied for carrying out the alternating cutting steps. The rotation axis of the separating disk is arranged on the one side of the material web to be separated, perpendicularly to the conveyor direction, in a manner such that the cutting edges of the cutting knives are able to be moved through the material webs. The cutting edges of the counter-knives are arranged on the other side of the material webs, and are aligned to the two end-sides of the separating disk. The rotating separating disk is operated running in the same direction as the conveying of the material webs. The alternating cutting knives have essentially straight-lined cutting edges, which lie in an alternating manner in the plane of the one or the other end-side of the separating disk, and which have two ends, of which the one is designed as a sharp cutting tip. The separating disk, the means for conveying the material webs, and the counter-knives are arranged relative to one another in a manner such that the cutting tip of the cutting knife meets the material webs first of all at the beginning of each cutting step, and the cutting edge of the cutting knife, with the cutting edge of the counter-knife, forms a cutting angle which at least inasmuch as the two cutting edges cross, is advantageously larger than 15° and smaller than 60°. The two cooperating cutting edges are thus never parallel to one another (only crossing cut, never full-edged cut), during the entire cutting step. The cut is effected in a cutting direction which runs oppositely or equally directed to the conveyor direction, depending on whether the cutting tip is leading or trailing, relative to the cutting edge.

The conveyor speed and the rotation speed of the separating disk are to be adapted to the design of the cutting knife, in a manner such that in each case a continuous cut arises on each side of the separating gap due to the alternating cutting steps, thus that the material webs are conveyed from cutting step to cutting step on each side of the separating gap by a distance which is not larger than the length of a cut which may be produced in one cutting step. A lower limit is set for the rotation speed of the separating disk for each conveyer speed by way of this condition. Advantageously, the separating disk, however, rotates significantly more quickly than with the mentioned minimal speed.

Experiments have found that the inventive method for separating continuously conveyed material webs provides paper edges of good quality if the separating gap or the separating disk is between 3 and 6 mm wide, in particular between 4 and 5 mm. Experiments have further revealed that an improved edge quality may be achieved, the greater is the diameter of the separating disk. It has however also been found than one may achieve good and in particular adequate results already with separating disks of a diameter in the region of approx. 160 to 250 mm, thus with separating disks which are significantly smaller than known separating disks which serve the same purpose. Such small separating disks permit a space-saving design of the device for carrying out the method according to the invention.

The method according to the invention and the device according to the invention may advantageously be applied for separating printed products which are designed as two-ups or multiple-ups, and which are conveyed one after the other or overlapping one another.

BRIEF DESCRIPTION OF THE DRAWINGS

Exemplary embodiments of the method and the device according to the invention are described in a detailed manner in combination with the following figures. Thereby there are shown in.

DETAILED DESCRIPTION OF THE INVENTION

Figure 1:
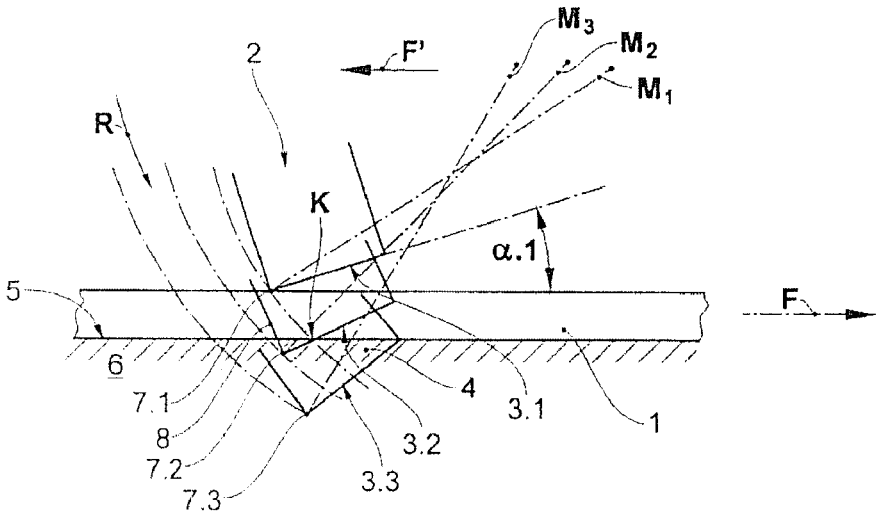
FIG. 1 a single cutting step of a first, exemplary embodiment of the method according to the invention for separating continuously conveyed material webs (cut along the arising separating gap), FIGS. 2 and 3 the cutting region of a device for separating continuously conveyed material webs according to the method according to FIG. 1

FIG. 1 illustrates a single cutting step of a first, exemplary embodiment of the method according to the invention. Thereby, the material webs 1 to be separated are represented in a stationary manner for the simplification of the representation, whilst the rotation axis M of the separating disk 2 moves in a direction F'. This corresponds to a conveying of the material webs 1 in the direction F with a stationary rotation axis M (conveying F and disk rotation R running in the same direction). Of the separating disk 2, only the cutting edge 3 of a single cutting knife 4 is represented. The cutting edge 5 of the stationary counter-knife 6 runs in the rest plane of the material webs 1, and perpendicular to the rotation axis M of the separating disk 2. The distance between the rotation axis M of the separating disk 2 and the surface of the material webs 1, or the cutting edge 5 of the counter-knife 6, is such that the cutting edge 3 of the cutting knife 4 arranged on the periphery of the separating disk 2, may completely penetrate the material webs 1. This means that an apex point of the separating disk 2 which lies on the other side of the cutting edge 5 of the counter-knife 6 has a distance to the cutting edge 5, which is larger than the radial distance between the two ends of the cutting edge 3.

The separating disk 2 and the counter-knife 6 are arranged relative to one another, and the cutting knife 4 is arranged on the separating disk 2, in a manner such that the radially outer lying end of the cutting edge 3 which trails the cutting edges 3 in the rotation direction 3 represents the cutting tip 7 firstly hitting the material webs 1, wherein this cutting tip 7 plunges into the material webs 1 at a location which is not yet cut, and the cutting direction (movement direction of the crossing point K of the cutting edges of the cutting knife and counter-knife) is the same as the conveyor direction F.

The cutting edge 3 of the cutting knife 4 is represented in three consecutive phases with the indices 0.1, 0.2 and 0.3. The cutting step begins in the first phase (index 0.1), which means that the cutting tip 7.1 meets the material webs 1. In the third phase (index 0.3) the cutting step is completed, which means that the complete cutting edge 3.3 is located on the side of the counter-knife 6 outside the material webs 1. The second phase (index 0.2) lies temporally roughly in the middle between the first and third phase, wherein the cutting edge 3.2 of the cutting knife 6 crosses the cutting edge 5 of the counter-knife 6.

As is evident from FIG. 1, the cutting angle alpha between the cutting edge 3 and the cutting edge 5 of the counter-knife 6 becomes larger during the cutting step. In the first phase, the cutting angle (alpha.1) is advantageously already greater than 15°, and during the cutting step does not become larger than 60° for example. Moreover, it is evident from FIG. 1 that the rotation speed R compared to the conveyor speed F must be of a magnitude such that the second edge 8, which together with the cutting edge 3 at an angle of advantageously 90° forms the cutting tip 7 and is not designed as a cutting edge, at no point in time of the cutting step, has a position relative to the material webs 1, which lies further upstream than the position of the first contact of the cutting tip 7.

Figure 2:
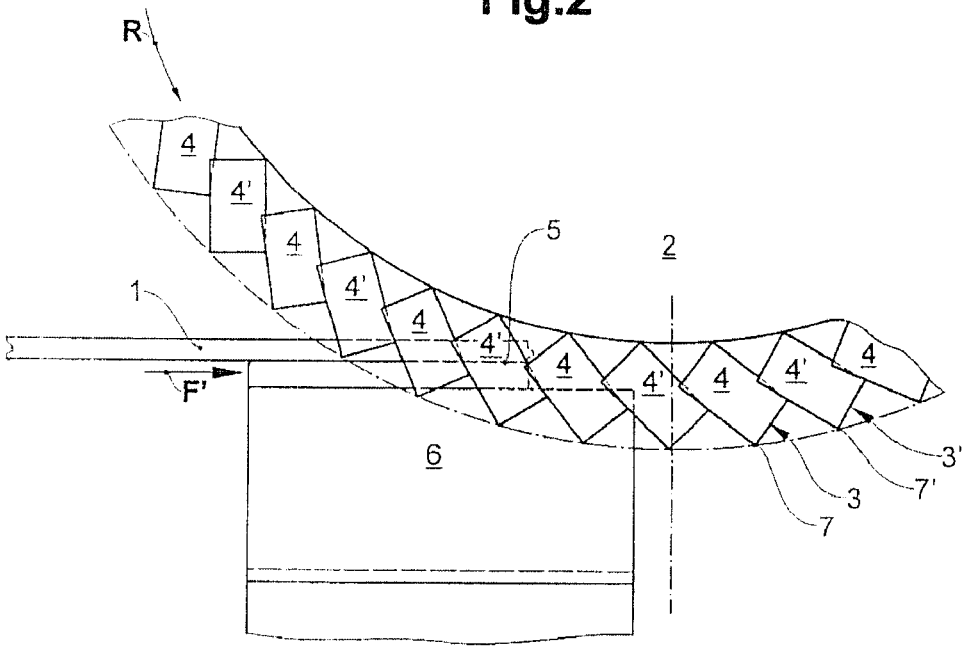
(FIG. 2: view parallel to the axis of the separating gap.
Figure 3:
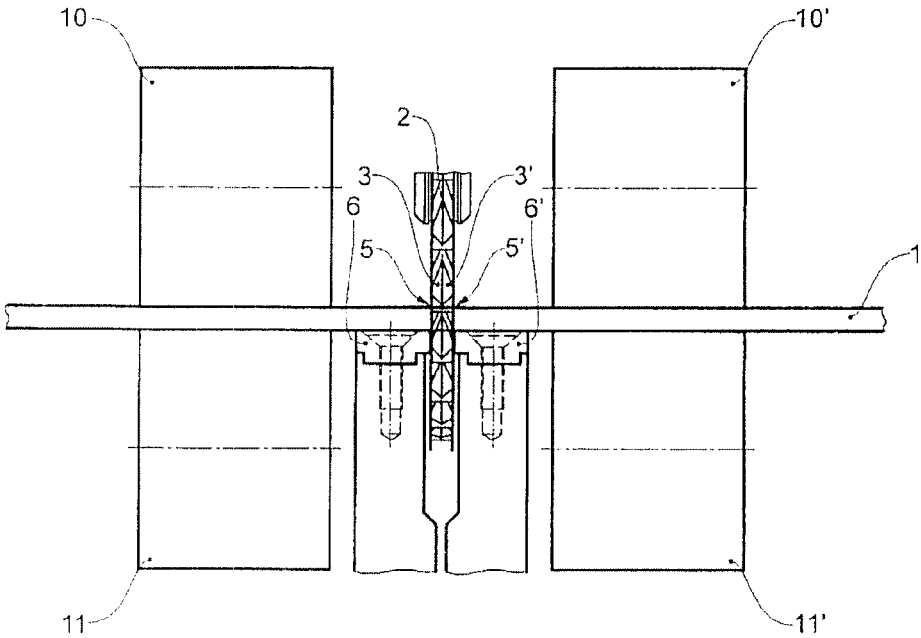
FIG. 3: section perpendicular to the separating gap)

FIGS. 2 and 3 show the most important constituents of a device according to the invention, for carrying out the method represented in FIG. 1. FIG. 2 shows the device with a viewing angle parallel to the separating disk axis, FIG. 3 sectioned transversely to the conveyor direction F. The mentioned, most important constituents are the separating disk 2, on whose periphery the alternating cutting knives 4 and 4' with cutting edges 3 and 3' are arranged, two counter-knives 6 and 6' with cutting edges 5 and 5' and pressing means 10/11 and 10'/11'.

The cutting edges 3 of the cutting knives 4 are arranged in the plane of the end-side of the separating disk 2 which is at the left in FIG. 3, and cooperate with the cutting edge 5 of the counter-knife 6. The cutting edges 3' are arranged in the plane of the right end-side of the separating disk 2 and cooperate with the cutting edge 5' of the counter-knife 6'.

The counter-knives 6 and 6' are advantageously arranged in a guided manner, such that they may be simply displaced parallel to the conveyor direction. With such a displacement, it becomes possible to replace a location of the cutting edge which has become locally worn due to the cutting step, by a location which has not been used or is less worn, which significantly prolongs the serviceable life of the counter-knife.

The pressing means 10/11 and 10'/11' which are only represented in FIG. 3, during the separation, press the material webs 1 onto one another on both sides of the arising separating gap and against the counter-knives 6 and 6', in a manner such that the material webs are applied onto the cutting edges 5 and 5' in a snug manner during the cutting steps. The pressing means may also serve as conveyor means additionally to their pressing function, with whose help the material webs are conveyed through the separating location, or they may support further conveyor means (not represented) in this conveying function. The pressing means are, for example, designed as pairs of pressing belts 10 and 11, or 10' and 11" which revolve in opposite directions about in each case at least two rollers (not represented), wherein the pressing belt 10 or 10' is arranged on the separating disk side, and the pressing belt 11 or 11' is arranged on the counter-knife side, and wherein the speed of the pressing belts corresponds to the conveyor speed. The pressing belts of the pairs 10/11 and 10'/11' or the rollers, over which they run, are pressed against one another with suitable resilient means. At least in each case one of the rollers is designed as an actively driven drive roller for an active conveyor function.

Figure 4:
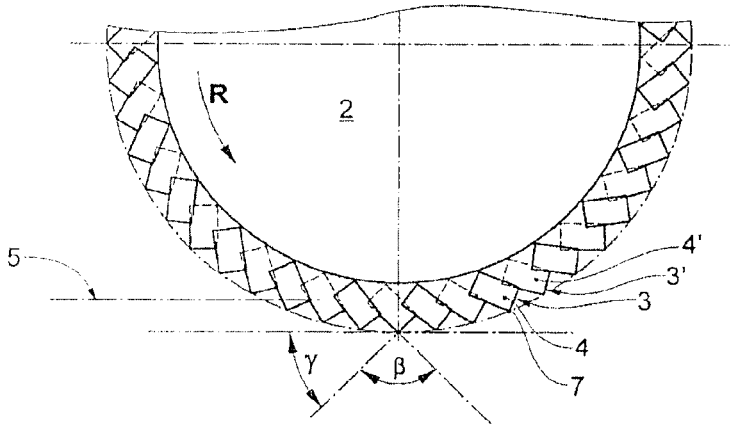
FIG. 4 an exemplary separating disk for carrying out the method according to FIG. 1 (viewing angle parallel to the disk axis)
Figure 5:
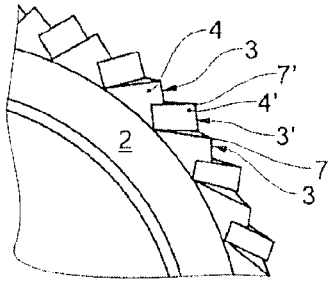
FIG. 5 a perspective representation of the cutting knife region of the separating disk according to FIG. 4.

FIGS. 4 and 5 show an exemplary embodiment of the separating disk 2 for the method according to FIG. 1. This with a diameter of only 200 mm, has for example 24 cutting knives 4 and 24 cutting knives 24' which alternate with these, whose cutting edges 3 and 3' are each between 5 and 15 mm, for example approx. 10 mm long. The angle beta between the edges of the cutting knife forming the cutting tip 7 is approx. 90° (between 85° and 95°), the angle gamma between the tangent to the cutting tip 7 and the cutting edge 3 is about 45°. The rotation direction R of the separating disk 2 is such that the radially outer ends of the cutting edges trail behind the cutting edges. The position of the cutting edge 5 of the counter-knife 6 is such that the radially outer ends of the cutting edges 3 hit the material webs first of all, and for this reason represent the cutting tips 7.

The separating disk 2, for example, is of one piece, which means it is manufactured from a solid disk, as is represented in FIG. 5. It may however also be manufactured of two mirror inverted disk parts, wherein the disk parts are arranged relative to one another in a manner such that the cutting knife of the one disk part is directed to the gaps between the cutting knives of the other disk part (see below FIG. 10+11). Two such part disks may be distanced from one another by a suitable amount for producing wider separating gaps by way of suitable intermediate disks. It is also quite evident from FIG. 5, as to how the cutting edges 3 and 3' of the cutting knives 4 and 4' are arranged in an alternating manner in the plane of the one and of other end-side of the separating disk 2. The cutting edges of the cutting knives may be reground in a simple manner and the cutting knives may also be designed in a self-sharpening manner.

Figure 6:
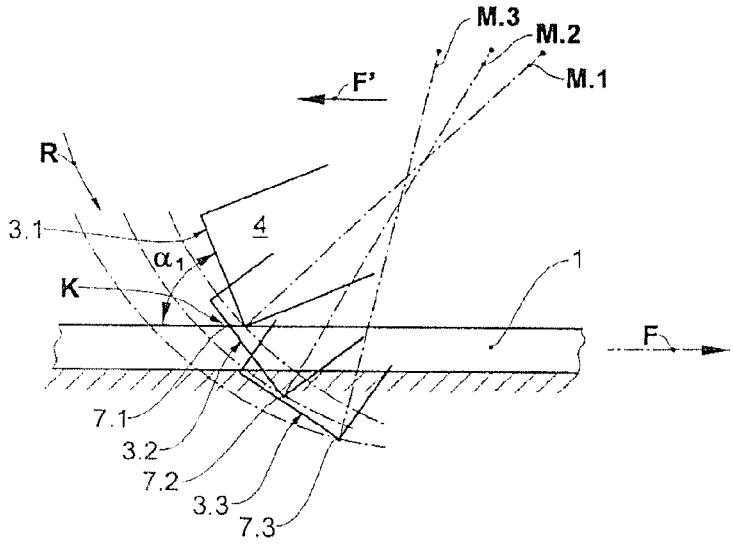
FIGS. 6 to 8 as FIGS. 1, 4 and 5, for a second exemplary embodiment of the method according to the invention for separating continuously conveyed material webs.
Figure 7:
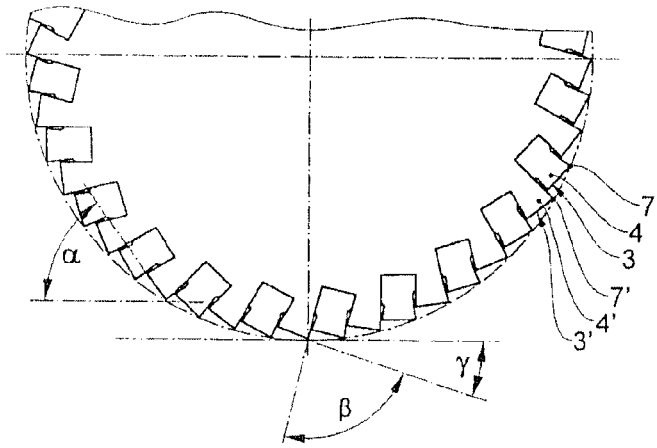
Figure 8:
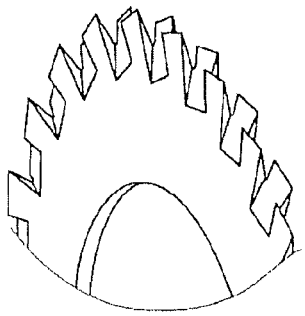

FIGS. 6 to 8 in the same representation manners as FIGS. 1, 4 and 5, show a second exemplary embodiment of the method and device according to the invention. The same elements are indicated with the same reference numerals. The main difference of this second embodiment compared to the first embodiment described in combination with the previous figures, lies in the fact that the cutting tips 7, although being the radially outer lying ends of the cutting edges 3, however lead the cutting edges. This means that the cutting tips 7 hit the material webs in the end region of the cut of the preceding cutting step, and the cutting point K moves opposite to the conveyor direction F (cutting direction opposite to the conveyor direction). The cutting angle alpha becomes smaller during the cutting step, but here too advantageously varies in a region below 60° and remains larger than 15°.

Figure 9:
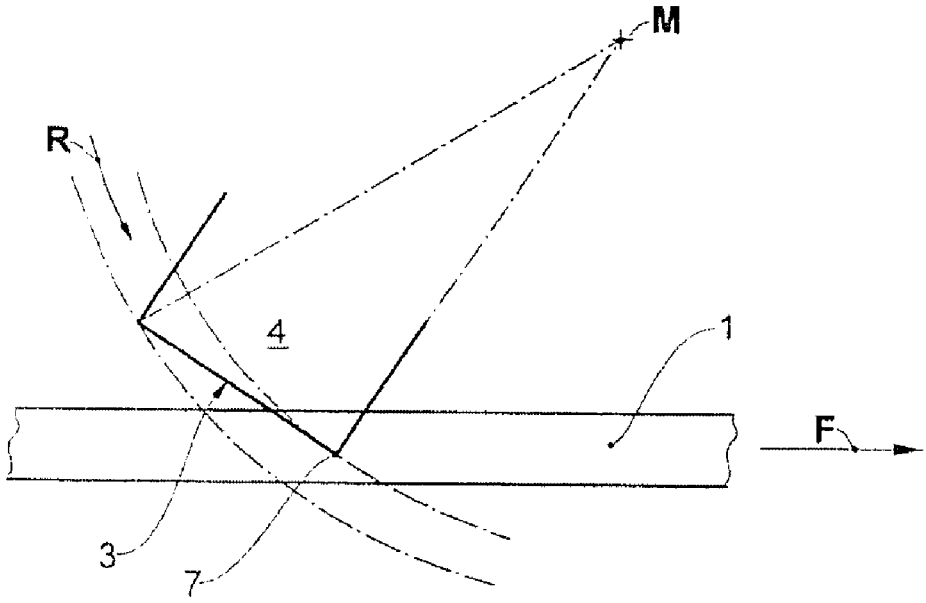
FIG. 9 a cutting step of a third exemplary embodiment of the method according to the invention.

FIG. 9 further shows a cutting step of a third, exemplary embodiment of the method according to the invention in a very schematic manner. According to this embodiment, the radially inner lying end (cutting tip 7) of the cutting edge 3 of the cutting knife 4 meets the material webs 1 first of all, and is arranged leading the cutting edge 3. The same cutting process as represented in FIG. 6 results, thus with a cutting direction which runs opposite to the conveyor direction and with a cutting angle which reduces in size during the cutting step. When comparing FIGS. 9 and 6, one may deduce that it is possible to arrange the two ends of the cutting edges 3 to the separating disk axis at the same radial distance, in a manner such that the cutting edges 3 run perpendicularly to a middle radius.

Examples of further embodiments of the method and the device according to the invention have the following features:

The counter-knives are not stationary but move in the conveyor direction with the same speed as the material webs.

Instead of a combination of a separating disk with a stationary axis with an essentially continuous conveying of the material webs, the material webs are stationary and the axis of the separating disk is moved parallel to the material webs, as is shown in the FIGS. 1 and 6. In this case, the pressing means too are stationary at least during the separation.

Instead of the axis of the separating disk being arranged above the material webs to be separated and the cutting edges of the counter-knives being arranged therebelow, the axis of the separating disk is arranged below the material webs, and the cutting edges of the counter-knives are arranged thereabove.

The conveyor direction is not horizontal.

The method according to the invention may, of course, not only be used for separating material webs, but also for cutting such material webs. Since, as initially mentioned for such a cutting, a high edge quality is only desired on the one side of the separating line, one may apply a separating disk on which the cutting edges of all cutting knives lies in the plane of the same disk end-side (see below FIG. 13).

Of course, there are materials other than material webs, which may be separated with a good quality with the method and the device according to the invention.

Figure 11:
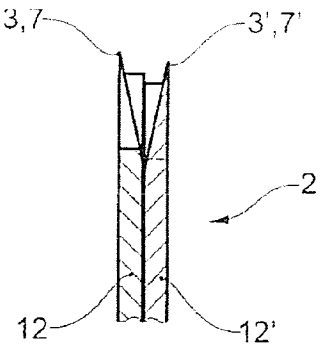
FIGS. 10-12 alternative designs of a separating disk, consisting of two disk parts in different views.
Figure 10:
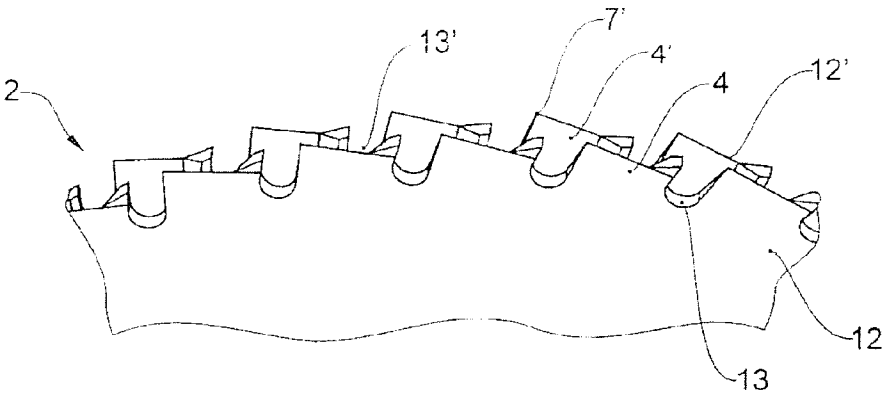
Figure 12:
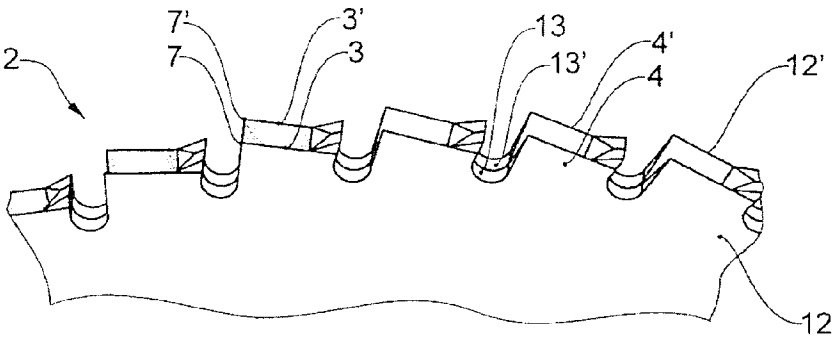

FIGS. 10-12 show examples for a separating disk 2, which is manufactured of two disk parts 12, 12' which are constructed in a mirror-inverted manner and which are assembled on one another with an angular offset (FIG. 10+11), or in a congruent manner (FIG. 12).

As the sectioned view of FIG. 11 shows, the axially outwardly facing surfaces of the disk parts 12, 12' are essentially plane. The respective inwardly facing surfaces are structured in order to form the cutting knives 4, 4'. In each case, notches 13, 13' are formed between the knives 4, 4', and these notches with regard to manufacturing technology, are such that sharp cutting tips 7, 7' may be formed at the cutting edges 3, 3' of the knives 4, 4'. The angular offset in the case of FIG. 10 is such that in each case a notch 13, 13' meets a cutting knife 4, 4' of the counter-disk.

In contrast to the case with a single-piece separating disk 2, advantages on manufacture exists with the two-part variant, since only one of the two main surfaces of a disk-like blank needs to be machined, in order to manufacture the knives 4, 4', and since the width of the waste strip may be adapted by way of differently wide spacers between the two disk parts 12, 12' (not represented). As indicated here, the outwardly facing end-face may have a chamfer of a few degrees in regions.

With the two arrangements according to FIGS. 10-12, a material strip is cut out of the material web by the cutting edges 3, 3' which are distanced to one another. In the case of FIG. 10+11, the part-cuts are carried out in an alternating manner, and in the case of FIG. 12, in a synchronous manner.

Figure 13:
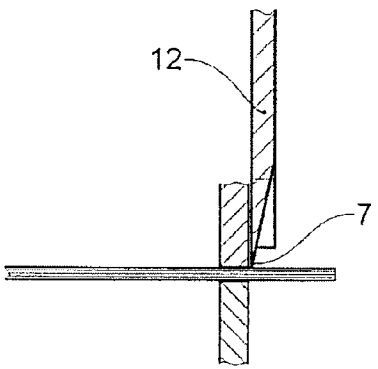
FIG. 13 the use of a single disk part for cutting a print shop product at a side edge.

FIG. 13 shows an example for the manufacture of a side cut of the material webs 1 with only one disk part 12, which is designed according FIG. 10 or 12. The material webs are pressed from above and below on cutting.

The invention claimed is:

1. A method for separating material webs which are conveyed in an essentially continuous manner in a conveyor direction, in a separating direction aligned essentially parallel to the conveyor direction, comprising the steps of:

providing a conveyor device for conveying the material webs;

providing a rotating separating disk, manufactured of two disk parts which are essentially constructed in a mirror-inverted manner, wherein the separating disk comprises a first end-side formed by a first disk part and a second end-side formed by a second disk part, and wherein a plurality of first and second cutting knives with essentially straight-lined cutting edges are arranged around the periphery of the separating disk, and wherein the cutting edges of the first cutting knives are arranged on the first disk part and lie in the plane of the first end-side and the cutting edges of the second cutting knives are arranged on the second disk part and lie in the plane of the second end-side, and wherein the two disk parts are assembled on one another with an angular offset of the first and second cutting knives or in a congruent manner of the first and second cutting knives;

providing a first counter-knife with an essentially straight-lined cutting edge, wherein the cutting knife is aligned onto the first end-side of the separating disk;

providing a second counter-knife with an essentially straight-lined cutting edge, wherein the cutting edge of the counter-knife is aligned onto the second end-side of the separating disk;

wherein the cutting edges of the first cutting knives of the rotating separating disk and the cutting edge of the first counter-knife form a first pair of cutting edges and the cutting edges of the second cutting knives of the separating disk and the cutting edge of the second counter-knife form a second pair of cutting edges, creating two parallel cuts in alternating cutting steps which are consecutive without intermediate steps or in synchronous cutting steps to form a separation gap and a waste strip, performing a shearing cut in the alternating or synchronous cutting steps wherein in each case a first and a second pair of the essentially straight-lined cutting edges of the cutting knives and counter-knives cooperate, whilst the material webs bear on the stationary cutting edges of the counter-knives.

2. The method according to claim 1, further comprising pressing the material webs against one another on both sides of the arising separating gap during the separation, in a manner such that they bear snugly on the counter-knives where the cutting edges act.

3. The method according to one of the claim 1, further comprising matching the alignment of cutting edges of the cutting knives, and of cutting edges of the counter-knives to one another in a manner such that an end of the cutting edges of the cutting knives which is designed as a cutting tip meets the material webs first of all.

4. The method according to claim 3, wherein the cutting tip leads the cutting edge, and wherein the material webs are cut in each cutting step in a cutting direction which runs opposite to the conveyor direction.

5. The method according to claim 3, wherein the cutting tip trails the cutting edge and wherein the material webs in each cutting step are cut in a cutting direction which is in the same direction as the conveyor direction.

6. The method according to claim 1, wherein a cutting angle (alpha) between the cutting edge of a cutting knife and the cutting edge of a counter-knife is larger than 15° and smaller than 60°, as long as the two cutting edges are crossed.

7. The method according to one of the claim 2, further comprising matching the alignment of the cutting edges of the cutting knives, and of the cutting edges of the counter-knives to one another in a manner such that an end of the cutting edges of the cutting knives which is designed as a cutting tip meets the material webs first of all.

8. The method according to claim 2, wherein a cutting angle (alpha) between the cutting edge of the cutting knife and the cutting edge of the counter-knife is larger than 15° and smaller than 60°, as long as the two cutting edges are crossed.

9. A device for separating material webs, conveyed in an essentially continuous manner in a conveyor direction, in a separating direction which is aligned essentially parallel to the conveyor direction, comprising:

a conveyor device for conveying the material webs;

a rotating separating disk, manufactured of two disk parts which are essentially constructed in a mirror-inverted manner, wherein the separating disk comprises a first end-side formed by a first disk part and a second end-side formed by a second disk part, and wherein a plurality of first and second cutting knives with essentially straight-lined cutting edges are arranged around the periphery of the separating disk, and wherein the cutting edges of the first cutting knives are arranged on the first disk part and lie in the plane of the first end-side and the cutting edges of the second cutting knives are arranged on the second disk part and lie in the plane of the second end-side, and wherein the two disk parts are assembled on one another with an angular offset of the first and second cutting knives or in a congruent manner of the first and second cutting knives;

a first counter-knife with an essentially straight-lined cutting edge, which is stationary during the separation, wherein the cutting knife is aligned onto the first end-side of the separating disk;

and a second counter-knife with an essentially straight-lined cutting edge which is stationary during the separation, wherein the cutting edge of the counter-knife is aligned onto the second end-side of the separating disk;

wherein during separation, the cutting edges of the first cutting knives of the separating disk and the cutting edge of the counter-knife form a first pair of cutting edges and the cutting edges of the second cutting knives of the separating disk and the cutting edge of the second counter-knife form a second pair of cutting edges, and the first and second pair of cutting edges in each case are arranged cooperating in a shearing cut for creating a separating gap with a waste strip by means of two parallel separating cuts between the first and second pair of cutting edges, wherein the conveying device is designed for conveying the material webs such that they bear on the cutting edges of the counter-knives.

10. The device according to claim 9, wherein the rotating separating disk is running in the same direction as the conveyor direction.

11. The device according to claim 9, further comprising means for pressing together the material webs and for the snug bearing of the material webs onto the counter-knives, which are preferably designed as active conveyors or auxiliary conveyors.

12. The device according to claim 9, wherein the cutting edges of the cutting knives and the cutting edges of the counter-knives are arranged in a manner such that ends of the cutting edges, which are designed as cutting tips meet the material webs before the cutting edges, and that these cutting tips lead or trail the cutting edges.

13. The device according to claim 9, wherein the separating disk in each case comprises a plurality of cutting knives with cutting edges for the first and the second pair of cutting edges, which are arranged in each case in a paired manner next to one another along the periphery of the separating disk, and are separated from one another in the peripheral direction by way of notches.

14. The device according to claim 10, further comprising means for pressing together the material webs and for the snug bearing of the material webs onto the counter-knives, which are designed as active conveyors or auxiliary conveyors.

15. The device according to claim 10, wherein cutting edges of the cutting knives and cutting edges of the counter-knives are arranged in a manner such that ends of the cutting edges, which are designed as cutting tips meet the material webs before the cutting edges, and that these cutting tips lead or trail the cutting edges.

16. The device according to claim 10, wherein the separating disk in each case comprises a plurality of cutting knives with cutting edges for the first and the second pair of cutting edges, which are arranged in each case in a paired manner next to one another along the periphery of the separating disk, and are separated from one another in the peripheral direction by way of notches.

* * * * *